United States Patent [19]

Matthews

[11] 4,222,850

[45] Sep. 16, 1980

[54] PROCESS FOR RETORTING OIL SHALE

[75] Inventor: Charles W. Matthews, Lakewood, Colo.

[73] Assignee: Gulf Research & Development Company, Pittsburgh, Pa.

[21] Appl. No.: 12,500

[22] Filed: Feb. 15, 1979

[51] Int. Cl.[2] ..... C10G 1/02

[52] U.S. Cl. ..... 208/11 R; 202/109

[58] Field of Search ..... 208/11 R; 202/109

[56] References Cited

U.S. PATENT DOCUMENTS

| | | | |
|---|---|---|---|
| 2,774,726 | 12/1956 | Eichna | 208/11 R |
| 3,318,798 | 5/1967 | Kondis et al. | 208/11 R |
| 3,573,194 | 3/1971 | Hopper et al. | 208/11 R |
| 3,736,247 | 5/1973 | Jones et al. | 208/11 R |

*Primary Examiner*—Herbert Levine

[57] ABSTRACT

This invention relates to a process for retorting raw shale comprising the following steps:

(1) passing raw shale downwardly through the upper zone of a two-zoned vertical retort;

(2) introducing a gas comprising molecular oxygen and flue gas at a temperature of about 590° to about 760° C., and ambient pressure into said upper zone and passing the same upwardly through said upper zone in contact with said raw shale;

(3) recovering from an upper part of said upper zone a product comprising shale oil and retort gas;

(4) passing the treated shale from a lower part of said upper zone downwardly through the lower zone of said two-zoned retort;

(5) introducing molecular oxygen at a temperature of about 25° to about 100° C. and flue gas at a temperature of about 25° to about 200° C., and ambient pressure into said lower zone and passing the same upwardly through said lower zone in contact with said treated shale;

(6) recovering from an upper part of said lower zone a preheated gas comprising molecular oxygen and preheated flue gas; and (7) recovering from a lower part of said lower zone spent shale.

30 Claims, 1 Drawing Figure

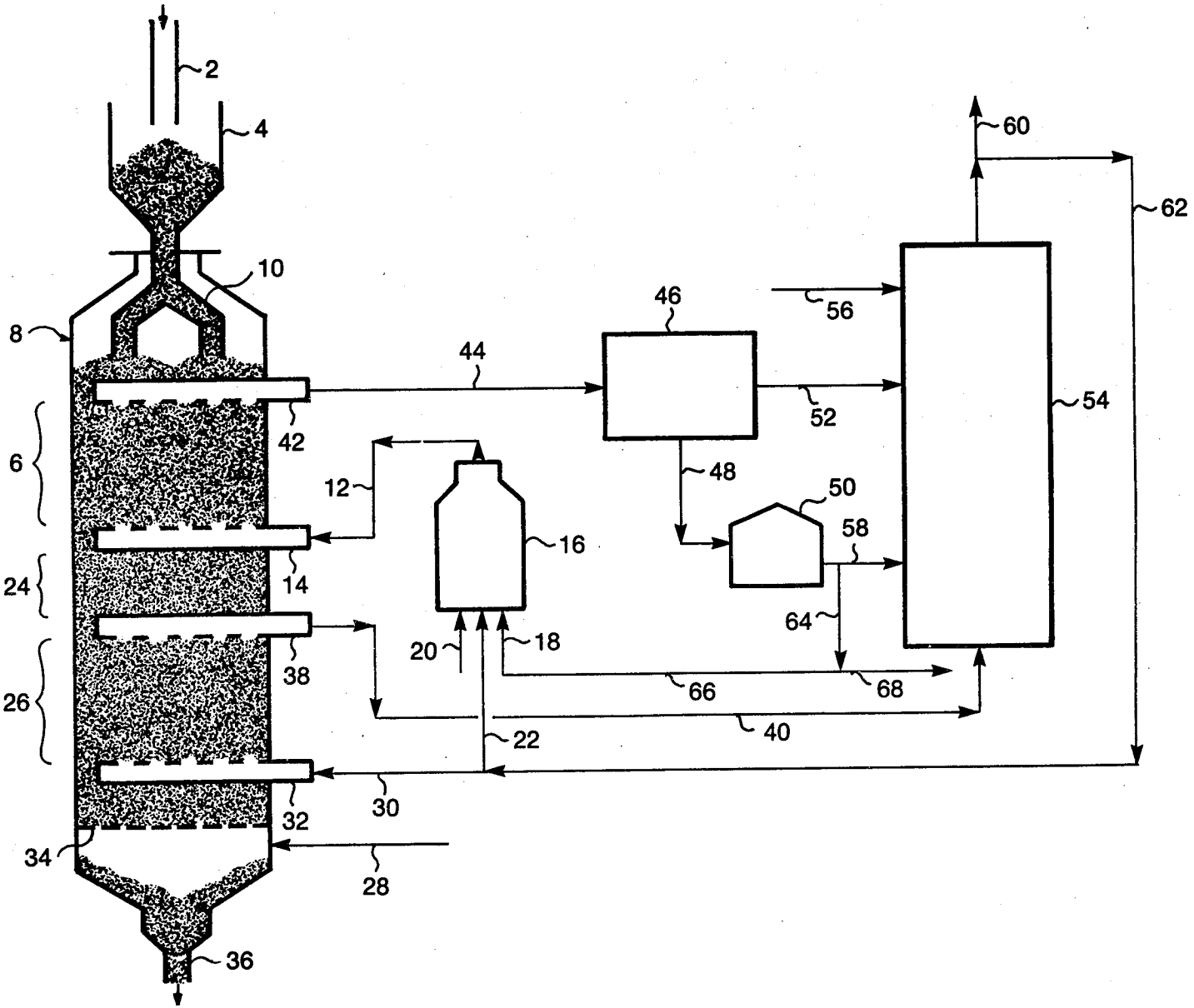
2
4
10
8
6
24
26
34
36
42
14
38
32
12
44
16
18
20
22
30
28
46
48
50
52
54
56
58
60
62
64
66
68
40

PROCESS FOR RETORTING OIL SHALE

BACKGROUND OF THE INVENTION

1. Field of the Invention

This invention relates to a process for retorting raw shale comprising the following steps:

(1) passing raw shale downwardly through the upper zone of a two-zoned vertical retort;

(2) introducing a gas comprising molecular oxygen and flue gas at a temperature of about 590° to about 760° C., and ambient pressure into said upper zone and passing the same upwardly through said upper zone in contact with said raw shale;

(3) recovering from an upper part of said upper zone a product comprising shale oil and retort gas;

(4) passing the treated shale from a lower part of said upper zone downwardly through the lower zone of said two-zoned retort;

(5) introducing molecular oxygen at a temperature of about 25° to about 100° C. and flue gas at a temperature of about 25° to about 200° C., and ambient pressure into said lower zone and passing the same upwardly through said lower zone in contact with said treated shale;

(6) recovering from an upper part of said lower zone a preheated gas comprising molecular oxygen and preheated flue gas; and (7) recovering from a lower part of said lower zone spent shale.

2. Description of the Prior Art

Unlike the invention herein, U.S. Pat. No. 2,774,726 to Eichna discloses a vertical shaft retort with complex internal structures. Raw shale enters a separate preheating zone into which non-combustion supporting gas at an elevated temperature has been injected. The non-combustion supporting gas is derived from gases leaving the combustion zone, recycle gas from the preheating zone, recycle product gas and air. The preheated shale enters a retort zone in which the shale is heated from exiting combustion gas. Shale from the retort zone flows into a combustion zone where it is burned in contact with a mixture of air and recycle gas from the preheating zone. Eichna differs from the invention herein in that the present invention has a two-zoned retort with the two zones being maintained by means of a substantially zero pressure differential across a section of the retort. As a result of maintaining such differential pressure, oxidizing gases can be handled in the lower zone and reducing gases in the upper zone. This concept is not disclosed by Eichna. Furthermore, the gas flow rates in the two zones of the retort in the present invention are different and are independently controlled. Finally, the preheated oxidizing gas injected to the lower part of the upper zone of the retort herein is for combustion and retorting, whereas the gas of Eichna is non-combustion supporting at low temperature for preheating shale and not for combustion and retorting.

U.S. Pat. No. 3,318,798 to Kondis discloses a vertical shaft retort which incorporates external combustion of recycled product gas and injection of the hot gas to the combustion zone of the retort. Kondis discloses a gas combustion retort that does not contain separate zones in which different gas streams which are independently varied flow. Further, cooling of shale is accomplished by recycling product gas and not by cooled flue gas. Cleanup of flue gas is not covered.

U.S. Pat. No. 3,573,194 to Hopper discloses a vertical retort in which the various steps of the process are contained in separate vessels, i.e., a preheating vessel, a retorting vessel, a combustion vessel, and a cooling vessel, arranged vertically. The objective of the Hopper disclosure is to retort at elevated pressure using inert gas, such as nitrogen and carbon dioxide, to obtain a shale oil of improved product quality. The steps of preheating, combustion, and cooling are accomplished at atmospheric or low pressure; however, the retorting step is at elevated pressures. Heat for retorting is supplied by gases from the combustion step, externally heated recycle product gas and externally derived inert gas. The invention herein is designed to provide an upper zone of a retort having carefully controlled maximum temperatures to decrease the possibility of slagging, agglomeration, and bridging within the retort. In the lower zone of the retort herein, sensible heat is recovered from retorted shale and is preferably injected to an external furnace, heater or boiler for heat recovery rather than to transfer that heat upward in the retort to the upper zone as is done in other retorts. As a result, the lower zone of the retort herein is also used for removal of sulfur oxides from flue gases, reduction of nitrogen oxides, and for recarbonation of decomposed mineral carbonates. In addition, combustion product gas which is evolved and heat of combustion which is generated in the lower zone can be transferred to an external furnace, heater or boiler.

Although the invention herein is effective for use with rich grades of shale feeds it is especially suitable for use with lean grades of shale which are not economically feasible for processing in conventional retorts.

SUMMARY OF THE INVENTION

I have discovered a process for retorting raw shale comprising the following steps:

(1) passing raw shale downwardly through the upper zone of a two-zoned vertical retort;

(2) introducing a gas comprising molecular oxygen and flue gas at a temperature of about 590° to about 760° C., and ambient pressure into said upper zone and passing the same upwardly through said upper zone in contact with said raw shale;

(3) recovering from an upper part of said upper zone a product comprising shale oil and retort gas;

(4) passing the treated shale from a lower part of said upper zone downwardly through the lower zone of said two-zoned retort;

(5) introducing molecular oxygen at a temperature of about 25° to about 100° C. and flue gas at a temperature of about 25° to about 200° C., and ambient pressure into said lower zone and passing the same upwardly through said lower zone in contact with said treated shale;

(6) recovering from an upper part of said lower zone a preheated gas comprising molecular oxygen and preheated flue gas; and (7) recovering from a lower part of said lower zone spent shale;

DESCRIPTION OF THE PROCESS

The process defined and claimed herein can be described by reference to the accompanying drawing. Shale to be treated herein is introduced into the system, preferably at ambient temperature (25° C.) and ambient pressure (about 12 pounds per square inch absolute) (83 kPa), by line 2, flows into shale feed hopper 4 and is led into upper zone 6 (Zone I) of a two-zoned vertical retort 8 by distributor 10.

Shale that can be used herein can be obtained from shale deposits in the Western States of the United States, especially the states of Colorado, Utah and Wyoming. It is often referred to as Green River oil shale, and a description of its typical composition is reported by Stanfield, K. E., Frost, I. C., McAuley, W. S., and Smith, H. N., in Bureau of Mines Report of Investigations Number 4825, 1951, entitled "Properties of Colorado Oil Shales", and also by Smith, J. W., in Bureau of Mines Report of Investigations Number 5725, 1961, entitled "Ultimate Composition of Organic Material in Green River Oil Shale." However, this process is also applicable to oil shales from other areas, such as Chattanooga shale from Tennessee.

The shale introduced into the system will preferably be crushed and screened to pass an opening of about one to about six inches (about 2.5 to about 15 centimeters), preferably about four inches (about 10 centimeters), and will be retained on about a one-eighth to about one inch (about 0.3 to about 2.5 centimeter) screen, preferably about a one-half inch (about 1.3 centimeter) screen.

The shale moves downwardly through Zone I at a rate of about 500 to about 1200 pounds (about 225 to about 550 kilograms), preferably about 600 to about 900 pounds (about 270 to about 400 kilograms) per square foot (per 0.09 square meter) of average cross-sectional area of Zone I per hour. In moving downwardly through Zone I the shale passes successively through a preheating section, a retorting section and a combustion section. In a preferred embodiment the upper, or preheating section, comprises about one-third of the volume of Zone I, and the middle, or retorting section, and the lower, or combustion section, about two-thirds of the volume of Zone I. The temperature in the preheating section can be in the range of about 25° to about 425° C., in the retorting section about 425° to about 510° C., and in the combustion section about 510° to about 760° C., preferably about 510° to about 650° C. The pressure in Zone I will be about ambient pressure.

There is also introduced into Zone I, by means of line 12 and distributor 14 a combustion gas containing molecular oxygen, nitrogen, carbon dioxide, water vapor and, perhaps, very small amounts of sulfur dioxide at a temperature of about 590° to about 760° C., preferably about 650° to about 700° C. Of the combustion gas in line 12 about one to about 15 volume percent, preferably about six to about 12 volume percent, will be molecular oxygen.

The combustion gas introduced into Zone I is preferably obtained in a combustor 16 wherein a fuel, introduced therein by line 18, is burned with air, introduced therein by line 20. Also introduced therein, by line 22, is a flue gas, containing mainly nitrogen and carbon dioxide and some water vapor, sulfur dioxide and molecular oxygen, for the purpose of moderating the temperature in combustor 16. The amounts of fuel, air and flue gas introduced into combustor 16, and the combustion parameters maintained therein, are adjusted so as to obtain a combustion gas in line 12, as defined hereinabove, to help obtain a rate of flow of such gas upwardly through Zone I, as defined hereinafter, and to help maintain pressures and temperatures in Zone I, as defined hereinabove. The flow of combustion gas upwardly through Zone I, countercurrently to the flow of shale therein, is at a rate of about 250 to about 380 pounds (about 11.4 to about 17.3 kilograms) per square foot (per 0.09 square meter) of average cross-sectional area of Zone I per hour.

Under the considerations defined above, the incoming shale in Zone I is preheated and then retorted to produce gaseous products, such as carbon dioxide, water vapor, nitrogen, carbon monoxide, hydrogen, hydrogen sulfide and some gaseous hydrocarbons and shale oil, which will be in the form of a fog or mist. Some mineral carbonate decomposition will also occur. As the shale continues to move downwardly in Zone I into the combustion section, organic material not previously removed or carbon deposited thereon, is burned with the excess oxygen present in the combustion gas entering Zone I by way of line 12.

The treated shale leaves Zone I at a temperature of about 510° to about 675° C., preferably about 540° C., passes through an intermediate volume 24, which will be described hereinafter, and then moves downwardly through a lower zone 26 (Zone II) of the two-zoned vertical retort 8. The rate of flow of treated shale downwardly through Zone II can be within the ranges defined hereinabove in reference to Zone I.

Also introduced into Zone II is air by line 28 and flue gas by line 30 and distributor 32. The entering air is at a temperature of about 25° to about 100° C., preferably about 25° to about 50° C., and ambient pressure. The entering flue gas is at a temperature of about 25° to about 200° C., preferably about 100° C. to about 200° C., and ambient pressure. The combined flow volume of air and flue gas upwardly through Zone II is at a rate of about 150 to about 230 pounds (about 70 to about 100 kilograms) per square foot (per 0.09 square meter) of average cross-sectional area of Zone II per hour.

As a result of the above, the treated shale, which had entered Zone II at about the same temperature and pressure that it had exited from Zone I passes through grate 34 and is removed from the system by line 36 at a temperature of about 100° to about 260° C., preferably about 200° C. The combined air and flue gas are removed from Zone II by header 38 and line 40 at a temperature of about 310° to about 650° C., preferably about 540° C., and ambient pressure.

Not only is the treated shale cooled in Zone II by contact with air and flue gas and air and flue gas heated therein, but shale that had been decarbonated and would therefore be in the form of oxides in Zone I will be recarbonated in Zone II by reaction with carbon dioxide present in the flue gas in line 30. Since such reaction is exothermic the gases leaving by way of line 40 are additionally heated. Any decarbonated shale leaving the system by line 36 and contacting water thereafter would have been highly basic and therefore ecologically undesirable. However, since partial recarbonation occurs in Zone II herein, the resulting product will be substantially neutral in pH and accordingly ecologically desirable. Additionally, any sulfur that is present in the flue gas introduced in Zone II will also react with the shale therein and will thus not be passed into the atmosphere.

Returning to intermediate volume 24, in order to avoid commingling of the gaseous products of Zone I with those of Zone II, it is imperative that there be substantially no pressure drop therebetween, that is, in intermediate volume 24. Thus the pressure drop should be in the range of about 0 to about 0.75 inch of water (about 0 to about 1.68 centimeters).

The organic products in Zone I are removed therefrom by take-off header 42 and line 44 at a temperature of about 50° to about 100° C., preferably about 65° C., and ambient pressure and passed to any conventional gas-liquid separator 46, operated, for example, at a temperature of about 50° to about 100° C. and ambient pressure.

The separated shale oil is removed from the gas-liquid separator 46 by line 48 and passed to oil storage unit 50, while the retort gas, comprising carbon dioxide, water vapor, nitrogen, carbon monoxide, hydrogen, hydrogen sulfide and some gaseous hydrocarbons, is removed from the gas liquid separator by line 52 and passed to any conventional furnace 54, operating, for example, as a steam boiler or process heater. Also introduced into furnace 54 is the heated gas in line 40 containing from about two to about 10 volume percent oxygen and air by line 56. In the furnace the flue gas is burned to produce heat. If desired, additional fuel for use in the furnace can be obtained from storage unit 50 by line 58. Since the oxygen content of line 40 is reduced by the flue gas, the temperature obtained in furnace 54 can be moderated to reduce the amount of nitrogen oxides otherwise produced therein.

The flue gas produced in furnace 54, comprising carbon dioxide, water vapor, nitrogen sulfur dioxide and oxygen is removed therefrom by line 60. A portion of such flue gas, approximately one-half, is preferably recycled by way of lines 62 and 30 to Zone II and/or lines 62 and 22 to combustor 16.

If desired, a portion of the recovered oil in oil storage unit 50 can be passed by lines 64 and 66 to constitute all or some of the oil supplied to combustor 16 by line 18 or can be removed from the system by line 64 and 68 as net shale oil.

DESCRIPTION OF PREFERRED EMBODIMENTS

It will be assumed that 2020 pounds (916 kilograms) of raw shale crushed and screened sufficient to pass a four-inch opening and capable of being retained on a one-half inch screen is introduced into the reaction system herein (Zone I), at ambient pressure and at ambient temperature. The shale contains 18.8 gallons (72 liters) of oil per ton of shale. On a moisture-free basis the shale will weight 2,000 pounds (907 kilograms) and will contain 8.46 weight percent organic carbon, 1.21 weight percent hydrogen, 0.29 weight percent nitrogen, 0.25 weight percent sulfur, 1.06 weight percent oxygen and 63.01 weight percent ash and 25.72 weight percent mineral $CO_2$. The latter is determined by reacting the shale with a strong acid, such as hydrochloric acid, and measuring the $CO_2$ evolved. The gross heating value of the shale is 1600 BTU per pound (3,700,000 joule per kilogram).

The retorted shale leaving Zone I will weight 1695.6 pounds (769.11 kilograms) and be at a temperature of 538° C. and will contain 1.3 weight percent carbon, 0.1 weight percent hydrogen, 0.1 weight percent nitrogen, 0.2 weight percent sulfur, 0.2 weight percent oxygen, 23.8 weight percent $CO_2$ and 74.3 weight percent ash. Spent shale leaving the system will weight 1696.4 pounds (769.47 kilograms) and be at a temperature of 204° C. The air supplied to the system by lines 20 and 56 will be at ambient pressure and a temperature of 16° C. and will amount to 445 pounds (202 kilograms) and 2422 pounds (1099 kilograms), respectively. No air in this example is supplied to Zone II.

The fuel will be supplied to combustor 16 at ambient pressure and a temperature of 66° C. in an amount of 14.2 pounds (6.44 kilograms) and will contain 84.84 weight percent carbon, 11.38 weight percent hydrogen, 2.00 weight percent nitrogen, 0.51 weight percent sulfur, 1.27 weight percent oxygen and have a gross heating value of 18,510 BTU per pound (43,050,000 joule per kilogram). The flue gas supplied to combustor 16 will amount to 370.2 pounds (167.9 kilograms) of gas at ambient pressure and will be at a temperature of 149° C. and will contain 13.5 volume percent of $CO_2$, 11.5 volume percent of water vapor, 71.8 volume percent of nitrogen, 0.067 volume percent of sulfur dioxide and 3.2 volume percent of oxygen.

The effluent from combustor 16 will amount to 847.8 pounds (384.6 kilograms), be at ambient pressure and a temperature of 677° C. and contain 10.1 volume percent $CO_2$, 8.4 volume percent water vapor, 72.7 volume percent nitrogen, 0.03 volume percent sulfur dioxide and 8.8 volume percent oxygen.

The oil product in line 48 will amount to 131.04 pounds and be at a temperature of 66° C. and the gaseous product in line 52 will amount to 978.1 pounds (443.7 kilograms), be at a temperature of 66° C., and will contain 20.5 volume percent $CO_2$, 17.6 volume percent water vapor, 59.1 volume percent nitrogen 0.9 volume percent CO, 0.6 volume percent hydrogen, 0.07 volume percent hydrogen sulfide and 1.3 volume percent gaseous hydrocarbon. The oil passed to the furnace 54 by line 52 will be at a temperature of 66° C. and can amount to 116.84 pounds (53.0 kilograms). In this example, no net oil is produced for removal from the system by line 68.

The total flue gas in line 62 will be at a temperature of 149° C. and can amount to 1542.7 pounds (700 kilograms). The flue gas introduced into Zone II by line 30 will amount to 1,172.5 pounds (531.8 kilograms). The preheated gas in line 40 supplied to furnace 54 will be at a temperature of 538° C. and will amount to 1,171.7 pounds (531.5 kilograms). The flue gas vented to the atmosphere by line 60 will be at a temperature of 149° C., will amount to 3,191.4 pounds (1447.6 kilograms) and will contain 13.5 volume percent $CO_2$, 11.5 volume percent water, 71.8 volume percent nitrogen, 0.067 volume percent sulfur dioxide, and 3.2 volume percent oxygen.

Obviously, many modifications and variations of the invention, as hereinabove set forth, can be made without departing from the spirit and scope thereof, and therefore only such limitations should be imposed as are indicated in the appended claims.

I claim:

1. A process for retorting new shale comprising the following steps:

(1) passing raw shale downwardly through the upper zone of a two-zoned vertical retort;

(2) introducing a gas comprising molecular oxygen and flue gas at a temperature of about 590° to about 760° C., and ambient pressure into said upper zone and passing the same upwardly through said upper zone in contact with said raw shale;

(3) recovering from an upper part of said upper zone a product comprising shale oil and retort gas;

(4) passing said retort gas to a furnace;

(5) passing the treated shale from a lower part of said upper zone downwardly through the lower zone of said two-zoned retort;

(6) introducing molecular oxygen at a temperature of about 25° to about 100° C. and flue gas at a temperature of about 25° to about 200° C., and ambient pressure into said lower zone and passing the same upwardly through said lower zone in contact with said treated shale;

(7) recovering from an upper part of said lower zone a preheated gas comprising molecular oxygen and preheated flue gas;

(8) introducing said preheated gas comprising molecular oxygen and preheated flue gas recovered from an upper part of said lower zone into a furnace; and (9) recovering from a lower part of said lower zone spent shale.

2. The process of claim 1 wherein said raw shale is introduced into said upper zone at ambient temperature and ambient pressure.

3. The process of claim 1 wherein said raw shale introduced into said upper zone is crushed and screened to pass an opening of about one to about six inches and will be retained on about a one-eighth to about one inch screen.

4. The process of claim 1 wherein said raw shale introduced into said upper zone is crushed and screened to pass an opening of about four inches and will be retained on about a one-half inch screen.

5. The process of claim 1 wherein said raw shale moves downwardly through said upper zone at a rate of about 500 to about 1200 pounds per square foot of average cross-sectional area of said upper zone per hour.

6. The process of claim 1 wherein said raw shale moves downwardly through said upper zone at a rate of about 600 to about 900 pounds per square foot of average cross-sectional area of said upper zone per hour.

7. The process of claim 1 wherein said gas introduced into said upper zone is at a temperature of about 650° to about 700° C.

8. The process of claim 1 wherein said gas introduced into said upper zone is passed upwardly therethrough at a rate of about 250 to about 380 pounds per square foot of average cross-sectional area of said upper zone per hour.

9. The process of claim 1 wherein said product comprising shale oil and retort gas is recovered from an upper part of said upper zone at a temperature of about 50° to about 100° C., and ambient pressure.

10. The process of claim 1 wherein said product comprising shale oil and retort gas is recovered from an upper part of said upper zone at a temperature of about 65° C., and ambient pressure.

11. The process of claim 1 wherein said raw shale is passed downwardly successively through a preheating section maintained at a temperature of about 25° to about 425° C., a retorting section maintained at a temperature of about 425°to about 510° C., and a combustion section maintained at a temperature of about 510° to about 760° C.

12. The process of claim 1 wherein the treated shale is removed from said upper zone at a temperature of about 510° to about 675° C., and ambient pressure.

13. The process of claim 1 wherein the treated shale is removed from said upper zone at a temperature of about 540° C. and ambient pressure.

14. The process of claim 1 wherein the treated shale moves downwardly through said lower zone at a rate of about 500 to about 1200 pounds per square foot of average cross-sectional area of said lower zone per hour.

15. The process of claim 1 wherein the treated shale moves downwardly through said lower zone at a rate of about 600 to about 900 pounds per square foot of average cross-sectional area of said lower zone per hour.

16. The process of claim 1 wherein said molecular oxygen and flue gas are introduced into said lower zone at a temperature of about 25° to about 50° C. and about 100° to about 200° C., respectively, and ambient pressure.

17. The process of claim 1 wherein said molecular oxygen and flue gas introduced into said lower zone are passed upwardly therethrough at a combined volume rate of about 150 to about 230 pounds per square foot of average cross-sectional area of said lower zone per hour.

18. The process of claim 1 wherein said preheated gas recovered from said lower zone is removed therefrom at a temperature of about 310° to about 650° C., and ambient pressure.

19. The process of claim 1 wherein said preheated gas recovered from said lower zone is removed therefrom at a temperature of about 540° C., and ambient pressure.

20. The process of claim 1 wherein there is no substantial pressure drop between and upper zone and said lower zone.

21. The process of claim 1 wherein the pressure drop between said upper zone and said lower zone is in the range of about 0 to about 0.75 inch of water.

22. The process of claim 1 wherein the spent shale is removed from said lower zone at a temperature of about 100° to about 260° C., and ambient pressure.

23. The process of claim 1 wherein the spent shale is removed from said lower zone at a temperature of about 200° C. and ambient pressure.

24. The process of claim 1 wherein said gas introduced into said upper zone is obtained by burning a fuel with molecular oxygen in an external combustor.

25. The process of claim 1 wherein said gas introduced into said upper zone is obtained by burning a fuel with molecular oxygen in the presence of a fuel gas in an external combustor.

26. The process of claim 1 wherein said shale oil and retort gas recovered from said upper zone are separated into a shale oil fraction and a retort gas fraction and said retort gas and said preheated gas recovered from said lower zone are introduced into a furnace.

27. The process of claim 1 wherein said shale oil and said retort gas recovered from said upper zone are separated into a shale oil fraction and a retort gas fraction and said retort gas fraction, said preheated gas recovered from said lower zone and molecular oxygen are introduced into a furnace.

28. The process of claim 1 wherein said shale oil and said retort gas recovered from said upper zone are separated into a shale oil fraction and a retort gas fraction and said retort gas fraction, said preheated gas recovered from said lower zone, molecular oxygen and at least a portion of said recovered shale oil are introduced into a furnace.

29. The process of claim 1 wherein said shale oil and said retort gas recovered from said upper zone are separated into a shale oil fraction and a retort gas fraction, said retort gas fraction, said preheated gas recovered from said lower zone, molecular oxygen and a portion of said recovered shale oil are introduced into a furnace and a portion of the flue gas produced in said furnace is recycled to constitute the flue gas introduced into said lower zone.

30. The process of claim 1 wherein said shale oil and said retort gas recovered from said upper zone are separated into a shale oil fraction and a retort gas fraction, said retort gas fraction, said preheated gas recovered from said lower zone, molecular oxygen and a portion of said recovered shale oil are introduced into a furnace, a portion of the flue gas produced in said furnace is recycled to constitute the flue gas introduced into said lower zone, another portion of said produced flue gas, another portion of said recovered shale oil and molecular oxygen are introduced into an external combustor and the products from said external combustor constitute said gas containing molecular oxygen and flue gas introduced into said upper zone.

* * * * *